US005531831A

United States Patent [19]

Sweeney et al.

[11] Patent Number: 5,531,831

[45] Date of Patent: Jul. 2, 1996

[54] STATIC BLENDING DEVICE

[75] Inventors: Kenneth W. Sweeney, Minocqua, Wis.; Harold G. Converse, Lake Elmo, Minn.

[73] Assignee: Minnesota Mining and Manufacturing Company, St. Paul, Minn.

[21] Appl. No.: 354,464

[22] Filed: Dec. 12, 1994

[51] Int. Cl.[6] ..... B05C 19/00

[52] U.S. Cl. ..... 118/600; 118/612; 118/308; 366/337; 366/340

[58] Field of Search ..... 118/600, 612, 118/308; 239/553, 553.5, 590.5; 366/340, 341, 337, 336

[56] References Cited

U.S. PATENT DOCUMENTS

| | | | |
|---|---|---|---|
| 269,850 | 1/1883 | Hadden | 222/200 |
| 1,233,417 | 7/1917 | Stephan | 239/455 |
| 1,834,917 | 12/1931 | Gilchrist | 366/106 |
| 1,857,463 | 5/1932 | Maclean | 427/188 |
| 1,925,282 | 9/1933 | Robinson | 428/144 |
| 1,928,275 | 9/1933 | Wettlaufer | 118/600 |
| 1,995,032 | 3/1935 | Leonard, Jr. | 427/186 |
| 2,015,084 | 9/1935 | McQuade | 52/518 |
| 2,253,652 | 8/1941 | Ritter | 428/208 |
| 2,684,690 | 7/1954 | Lee | 239/590.5 |
| 2,741,464 | 4/1956 | Conover | 366/153.2 |
| 3,074,727 | 1/1963 | Sosalla et al. | 239/590.5 |
| 3,998,393 | 12/1976 | Petty | 239/590.5 |
| 4,185,780 | 1/1980 | Duchene et al. | 239/553.5 |
| 4,617,198 | 10/1986 | Overturf | 427/186 |
| 4,627,990 | 12/1986 | Saga et al. | 427/10 |
| 4,798,164 | 1/1989 | Marazzi | 118/612 |
| 5,114,076 | 5/1992 | Imai et al. | 239/338 |
| 5,283,080 | 2/1994 | Lamb et al. | 427/8 |

FOREIGN PATENT DOCUMENTS

| | | |
|---|---|---|
| 726570 | 1/1966 | Canada . |
| 959155 | 12/1947 | France . |
| 648274 | 7/1937 | Germany . |
| 706166 | 10/1941 | Germany . |
| 1233760 | 2/1967 | Germany . |
| 727726 | 8/1978 | U.S.S.R. . |
| 1583156A1 | 7/1990 | U.S.S.R. . |

*Primary Examiner*—Laura Collins

*Attorney, Agent, or Firm*—Gary L. Griswold; Walter N. Kirn; Michaele A. Hakamaki

[57] ABSTRACT

A static blending device for continuously blending particulate matter for even dispersion onto a substrate, wherein blending can be achieved automatically by gravity flow of the material. The static blending device includes an inlet for receiving particulate matter and an outlet for dispensing particulate matter and a dispersing section provided between the inlet and the outlet that is divided into a first compartment and a second compartment. The first and second compartment are each preferably divided into a manifold cavity and a transfer section by a manifold plate with multiple manifold openings that is positioned on an angle within each compartment. The transfer section in each compartment is preferably further divided by multiple divider plates into multiple lanes that correspond with at least one of the manifold openings so that the particulate matter entering the manifold cavity of the front compartment falls through the manifold openings in its manifold plate and is shifted by the multiple lanes toward one transverse end of the outlet and the particulate matter entering the manifold cavity of the rear compartment falls through the manifold openings of its manifold plate and is shifted by the multiple lanes toward the other transverse end of the outlet.

18 Claims, 6 Drawing Sheets

STATIC BLENDING DEVICE

FIELD OF THE INVENTION

The present invention relates to a static blending device for blending particulate matter for improving dispersion. The invention particularly concerns mixing or dispersion of roofing granules for application to asphalt roofing systems and products, such as asphalt roofing shingles. According to the present invention there is provided an improvement in the process of mixing or dispersion that minimizes particulate matter segregation.

BACKGROUND OF THE INVENTION

Asphalt-based roofing systems and products are well known. They include, for example, asphalt shingles and asphalt roll roofing. Many conventional materials are utilized as raw materials in the manufacture of these asphalt roofing materials.

Asphalt roofing materials comprise a substrate which is filled and coated with various asphalt materials. Generally, the substrate is filled with a "saturant" asphalt to provide waterproofing and saturation of the substrate. The saturated substrate is usually sealed by application of a harder, more viscous "coating" asphalt to one or both sides of the substrate.

The exterior, outer, or exposed surface of asphalt roofing materials is generally provided with a covering of granular material or roofing granules embedded within the coating asphalt. The roofing granules generally protect the underlying asphalt coating from damage due to exposure to light, particularly ultraviolet (UV) light, and also improve both fire resistance and weathering characteristics. In addition, roofing granules are typically coated with a colored coating for aesthetic reasons. The roofing materials may include solid colors or blends of more than one color of granule, and specific colors of granule blends may be obtained by varying the proportions of different colored roofing granules combined in the granule blend. In addition, roofing granules with specific functional characteristics may be dispersed throughout the granular blend to achieve some desired performance of the roofing material. For example, algae-inhibiting roofing granules may be dispersed throughout a granular blend to inhibit the growth of algae on the roofing granules or roofing material.

In the roofing industry, it is desirable for the various sizes, types, or colors of roofing granules in a granule blend to be evenly dispersed across the surface of the roofing material to achieve a uniform appearance or functionality. However, even dispersion cannot be achieved if the roofing granules are inadequately blended or mixed before being applied to the roofing material. One common problem that occurs when various sizes, types, or colors of roofing granules are unevenly dispersed throughout a granule blend is referred to as granule segregation. When segregated roofing granules are applied to a roofing material that is later applied to a roof, the result is that some areas of the roof may vary in appearance or functionality.

One specific type of problem that arises when roofing granules are not properly blended is commonly known as "shading". Shading may be seen as the roof is viewed from different angles or under different light conditions, where those areas of a roof with segregated roofing granules may appear lighter or darker than other areas of the roof. This may happen even when the granule blend contains only roofing granules of a single color.

Shading is typically easier to perceive when viewing the roof at certain angles or under particular lighting conditions, but in fact may be visible any time the viewer is looking at the roof. Shading problems may occur on roofing materials where the granule blend includes various roofing granule colors, various roofing granule sizes, or both. For example, shading may occur on black shingles where different sized black roofing granules are segregated on the shingle, or similarly may occur in a mixture where the roofing granules are the same size but different colored roofing granules are more concentrated on one area of the shingle than others. Although the granule blend variations are often not detectable when looking at individual shingles or roofing materials, distinct lines or patterns of darker or lighter areas may appear when these roofing materials are actually applied to a roof. If the shading is distinct enough to detrimentally effect the appearance of the roof, the overall roof appearance may be considered unacceptable.

Attempts have been made to achieve better mixing of granule blends. For example, it is known to use some type of mixing, blending, or dispersing device that improves the roofing granule blending prior to placing the granule blend on the roofing material or shingles. Dispersing devices such as illustrated in FIGS. 6 and 7 have been used for this purpose in the roofing industry. More specifically, FIG. 6 illustrates a typical device for dispersing roofing granules. Radially oriented baffle plates are positioned within this device so that granules that enter the top of the device and fall through the device will be deflected by the baffle plates to spread the granules across the width of the bottom, or outlet, of the device which is typically wider than the top, or inlet, of the device. The dispersing device illustrated in FIG. 7 similarly may be used to disperse granules across a specific width; however, this device uses several angled baffle plates spaced from one another to split the streams of granules as they fall from the inlet toward the outlet of the device, thereby allowing for some mixing of the roofing granules as they fall through the device. Devices of this type typically operate most effectively when the granules flow freely through the device so that as granules strike the baffle plates, they can easily move about within the device. In other words, blenders of this type typically do not operate well in a "choke-fed" situation, where the device becomes completely filled with granules. Although these dispersing devices and blenders may improve roofing granule blending, they have not generally been able to achieve the level of dispersion necessary to eliminate granule segregation.

Another method used to achieve a more even dispersion of roofing granules is the use of dynamic mixers. Such mixers may also be used in combination with the dispersing devices described above. Unfortunately, certain groups of roofing granules tend to migrate in a pattern to certain areas of the granule blend during the mixing process so that a true uniform mixture won't necessarily be achieved. Although these patterns may sometimes be overcome by increasing the time and/or intensity of mixing, an undesirable side effect of increased mixing is that the frictional contact of the roofing granules with each other during mixing causes the roofing granules to wear down. Therefore, although increasing the time of mixing the roofing granules before applying them to the roofing materials may decrease roofing granule segregation and improve the uniformity of the granule blend, the roofing granules consequently may also become so excessively worn that they are no longer suitable for their intended application.

A like concern arises when dealing with granule blends where certain roofing granules are added to the granule blend in a specific proportion for a specific functional purpose. For example, when algae-inhibiting granules are mixed into a granular blend in the correct proportion, they help to preserve both the color and the life of the roofing material to which they are applied. If the algae-inhibiting granules are not evenly dispersed in the granule blend, the full benefit of these roofing granules may not be achieved. Again, although increasing the amount of roofing granule mixing would typically provide for a more uniform blend of the algae-inhibiting roofing granules within the granular blend, the roofing granules themselves may show excessive wear from the mixing process.

Clearly, beneficial results may be achieved by decreasing segregation and improving the dispersion of roofing granules in roofing systems and products while minimizing wear on the roofing granules. Even in situations where granule blends were generally considered satisfactory, improvements are still desirable.

SUMMARY OF THE INVENTION

The present invention is generally related to a static blending device for blending particulate matter, such as roofing granules, for even dispersion onto a substrate. More specifically, the present invention provides a static blending device of simple construction which can continuously blend materials and which is less inclined to detrimentally effect the blended components. With this invention, blending can be achieved automatically by gravity flow of the material using a choke-fed system without the need to control the granule feed rate to prevent the device from becoming completely filled with granules (i.e., free movement of the granules within the device of the present invention is not necessary). Further, with this invention, blending can be carried on continuously, that is, in such fashion that new material is fed into the inlet at a rate commensurate with its outflow at the outlet.

The static blending device in accordance with the present invention preferably includes an inlet for receiving particulate matter and an outlet for dispensing particulate matter, where the outlet is preferably wider than the inlet in the transverse direction. A dispersing section is provided between the inlet and the outlet and is divided into a first compartment and a second compartment by a splitter element that extends in the transverse direction of the inlet and the outlet. A means is provided in the first compartment for moving the particulate matter in the first compartment toward one transverse end of the outlet as it falls from the inlet toward the outlet, and a means is provided in the second compartment for moving the particulate matter in the second compartment toward the other transverse end of the outlet as it falls from the inlet toward the outlet.

The static blending device may further include a manifold plate with multiple manifold openings in the front compartment that divides its dispersing section into a manifold cavity and a transfer section, and a manifold plate with multiple manifold openings in the rear compartment that divides its dispersing section into a manifold cavity and a transfer section. Moreover, the transfer section of both the front and rear compartments are preferably further divided into multiple lanes by multiple divider plates so that the particulate matter entering the manifold cavity of the front compartment falls into the multiple lanes through the multiple manifold openings and is shifted toward one transverse end of the outlet and the particulate matter entering the manifold cavity of the rear compartment falls into the multiple lanes through the multiple manifold openings and is shifted toward the other transverse end of the outlet. More preferably, the particulate matter supplied to the static blending device in accordance with the present invention may be roofing granules.

According to another aspect of the present invention, a method for blending particulate matter includes providing a static blending device with an inlet, an outlet, and an intermediate dispersing section having plural compartments and splitting the particulate matter that is supplied to this device so that some of the particulate matter falls into each of the plural compartments. After the material falls into the plural compartments, it is preferably shifted within the compartments so that the material within one compartment moves in one direction and the material that falls into another compartment moves in another direction as it falls from the inlet toward the outlet. The particulate matter is then dropped from the static blending device and applied to a substrate.

DETAILED DESCRIPTION OF THE PREFERRED EMBODIMENT

Figure 1:
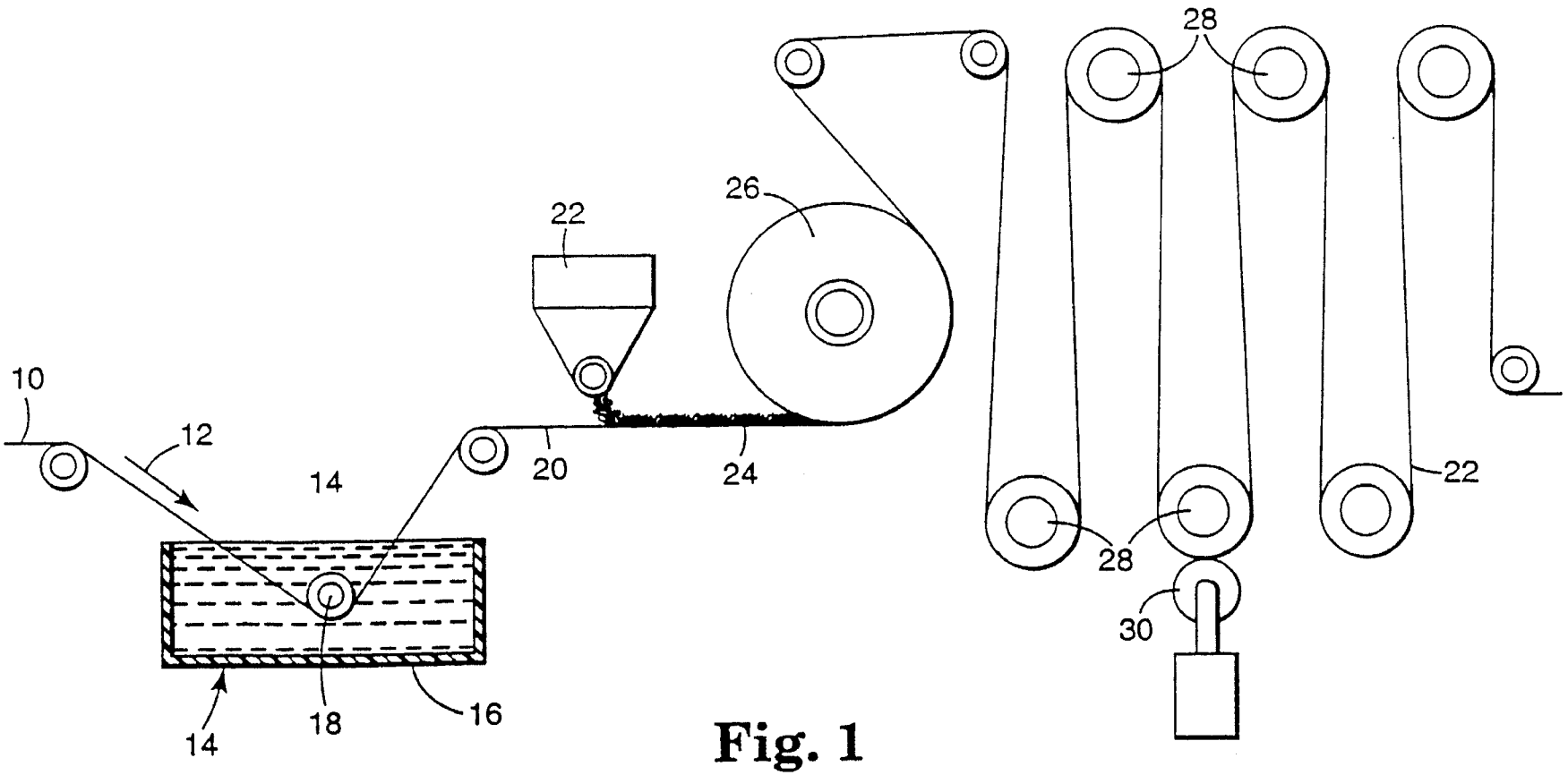
FIG. 1 is a schematic illustration of a typical method of manufacturing granule-covered roofing materials.

Referring now to the Figures, wherein the components are labeled with like numerals throughout the several figures, and initially to FIG. 1, a typical method of manufacturing asphalt shingles or roofing materials is illustrated. As shown in FIG. 1, base sheet 10, which is preferably a dry felt or glass fiber mat, moves within the manufacturing operation in the direction indicated by arrow 12. Base sheet 10 is subjected to a hot asphalt saturating process, indicated generally by the coater 14. The saturating process is conducted by passing the base sheet 10 through saturation tank 16 in which hot liquid asphaltic material and a coating roller 18 are contained, to create a continuous hot strip of saturated sheeting 20. Note that a typical subsequent step (not illustrated) is to apply an additional layer of coating asphalt to the saturated sheeting 20 after this saturating process.

The saturated sheeting 20 is then passed beneath a granule hopper 22 for the discharge of roofing granules onto the top surface of the saturated sheeting 20 to produce a granule-covered asphaltic material 24. As used throughout this application, the term roofing granule is preferably meant to include particulate matter such as is commercially available from Minnesota Mining and Manufacturing Company of St. Paul, Minn. or other similar particulate matter used in roofing applications. The granule-covered asphaltic material 24 then passes around a backfall drum 26 where excess roofing granules are removed and then moves into the cooling section, where the material travels through a series of rollers 28. Also positioned within the cooling section are means for cooling the granule-covered asphaltic material 24 (not shown), which may include blowers or any cooling means known in the art.

In order to obtain proper adhesion of the roofing granules, the granule-covered asphaltic material 24 is subjected to controlled pressure by a granule press 30 which forces the roofing granules into the granule-covered asphaltic material 24 by a predetermined depth. The granule press 30 is typically located within the manufacturing process in the position that optimizes the process of embedding the roofing granules into the granule-covered asphaltic material 24, which may be in a different location than that illustrated in FIG. 1. The granule-covered asphaltic material 24 may be subjected to additional cooling and or processing steps after leaving the granule press 30 and before being processed into some desired size or shape, such as shingles or a roll of roofing material. It will be understood that the finished material may be modified, for example, by the addition of liners, application adhesives, or other modifications.

The present invention is specifically related to a static blending and dispersing device used in the step of the manufacturing process described above where roofing granules are discharged onto the top surface of the saturated sheeting 20. It is to be understood that the blending and dispersing device of the present invention is preferably used for dispersing roofing granules directly onto the saturated sheeting 20; however, the above described method of manufacturing asphalt shingles is only a representative method and the device of the present invention may be used in another location in this manufacturing process or in a different manufacturing process. For example, the device of the present invention may be used to blend roofing granules and discharge them into a hopper or storage container prior to dispensing the roofing granules onto the saturated sheeting or other web material. It is further contemplated that the blending and mixing device of the present invention be used for blending any particulate matter and not specifically only roofing granules, such as powders, grains, and the like, wherein it is desirable to have an even dispersion of particulate matter within a hopper or as applied to a surface.

Figure 2:
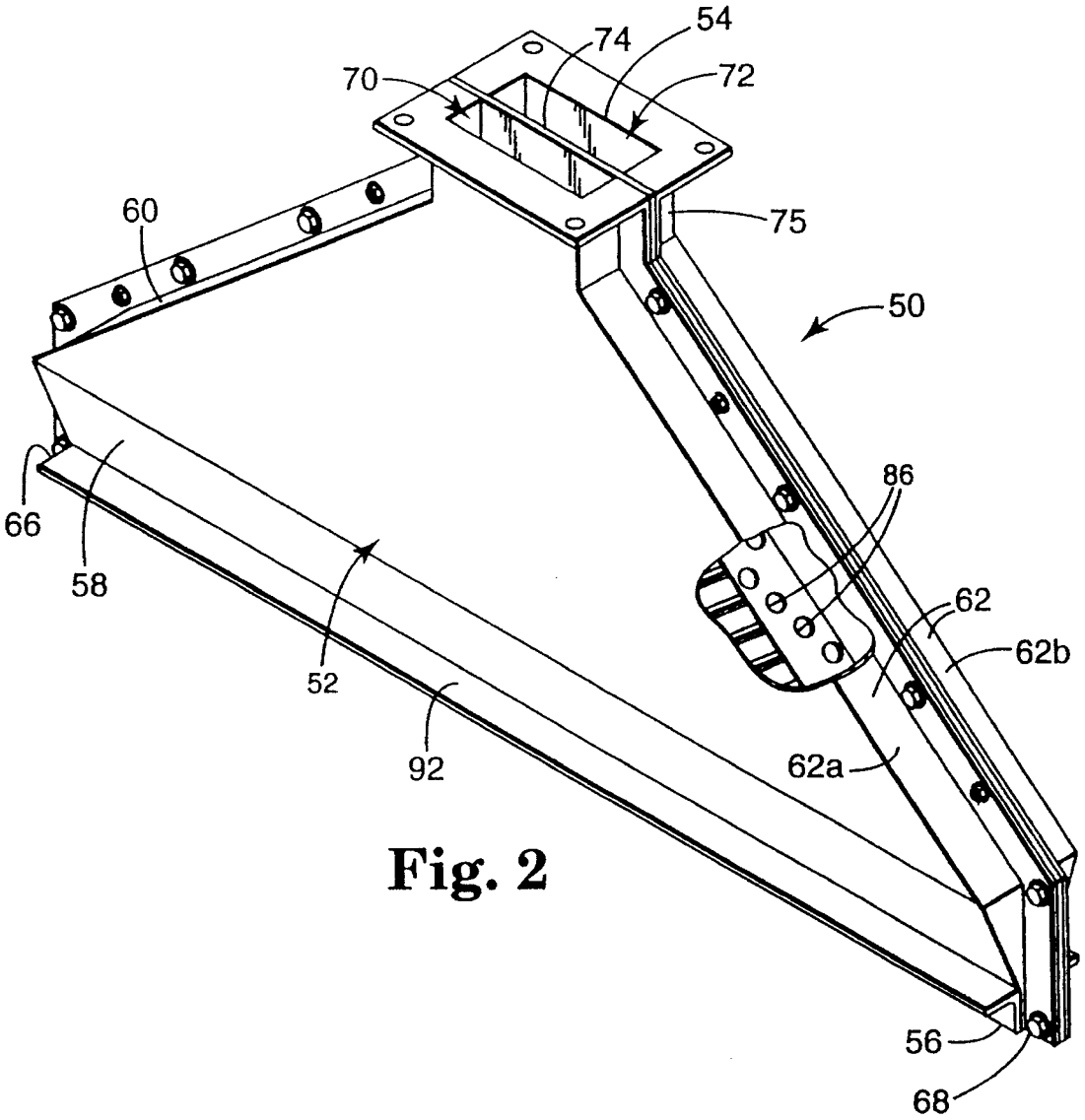
FIG. 2 is a perspective view of the blending and dispersing device in accordance with a preferred embodiment of the present invention.

FIG. 2 illustrates a preferred embodiment of the present invention, where a blending and dispersing device 50 generally comprises a dispersing section 52 provided functionally intermediate of an inlet 54 and an outlet 56. The preferred orientation of the blending and dispersing device 50 is shown in FIG. 2, where the inlet 54 is positioned above and the outlet 56 is located below the dispersing section 52. In this orientation, the force of gravity can be sufficient to move particulate matter from the inlet 54 toward the outlet 56. However, it is to be understood that the blending and dispersing device 50 may be utilized in other orientations as long as appropriate forces are provided to move the particulate matter from the inlet 54 toward the outlet 56 by way of the dispersing section 52. For example, the device 50 may be situated in nearly any orientation if the particulate matter is fed into the inlet 54 of the blending and dispersing device 50 under sufficient external pressure to move the particulate matter through the device.

The shape of the dispersing section 52 may be widely varied; however, in the preferred embodiment, the dispersing section 52, as best illustrated in FIG. 2, comprises a substantially triangular shaped front wall or cover 58 and side walls 60 and 62 that diverge from one another when moving from the inlet 54 toward the outlet 56. A rear wall 64 (shown in FIG. 4) of a shape preferably similar to the front wall 58 completes the general shape of the dispersing section 52. In this configuration, the width of the opening of the inlet 54 in the transverse direction is smaller than the width of the opening of the outlet 56, where the transverse direction of the outlet 56 is defined between two transverse ends 66 and 68. In addition, the front wall 58 and rear wall 64 are preferably symmetrical about their vertical centerlines.

Many other configurations of the outer shell of the dispersing section 52 are also contemplated by the present invention other than that described above, but preferably the transverse width of the outlet 56 is larger than the transverse width of the inlet 54. For example, the dimensions of the front wall 58 may be different than the dimensions of the rear wall 60 and/or the front wall 58 and rear wall 60 may not be symmetrical about their vertical centerlines. It is also contemplated that the side walls 60 and 62 may comprise curved surfaces instead of the straight walls illustrated in the preferred embodiment, that there may be multiple combinations of straight and curved side walls 60 and 62, or that the side walls 60 and 62 may be provided with a step-like profile. As shown, each of the side walls 60 and 62 are made up of two portions, one of which is integral with the front wall 58 and the other of which is integral with the rear wall 64. These two portions of the side walls 60 and 62 are flanged together to effectively make up the single side walls 60 and 62. For example, side wall 62 is made up of side portions **62*a* and 62*b*, where side portion 62*a* is integral with the front wall 58 and the side portion 62*b* is integral with the rear wall 64 and the side portions 62*a* and 62*b* are flanged together to effectively make up side wall 62**.

The dispersing section 52, and preferably the inlet 54, as shown in FIG. 2, are divided into a front compartment 70 and a rear compartment 72 by a splitter element 74. The transverse width of the splitter element 74 is preferably larger at the outlet 56 than at the inlet 54 and preferably follows the shape of the front wall 58 and the rear wall 64 of the dispersing section 52, so long as the splitter element 74 functionally separates the two compartments 70 and 72. The front compartment 70 is defined between the front wall 58 of the dispersing section 52 and the splitter element 74 and between the side walls 60 and 62, and the rear compartment 72 is defined between the rear wall 64 of the dispersing section 52 and the splitter element 74 and between the side walls 60 and 62. By this arrangement, the particulate matter entering the inlet 54 will fall immediately into either the front compartment 70 or the rear compartment 72, or drop upon or strike the top of the splitter element 74 so that some of the particulate matter will fall into the front compartment 70 and the remaining particulate matter will fall into the rear compartment 72. Although it is preferable that the splitter element 74 divides the dispersing section 52 into two equal compartments (i.e., the size of the front compartment 70 is equal to the size of the rear compartment 72), it is also contemplated that the splitter element is closer to either the front wall 58 or the rear wall 64 so that the front compartment 70 and the rear compartment 72 are different sizes.

The splitter element 74 preferably comprises a rigid plate of material such as aluminum, steel, or the like, but any material that is capable of separating the front compartment 70 and the rear compartment 72 may be used, such as heavy film products, screen materials, or the like. It is further contemplated that there may be multiple splitter elements that divide the dispersing section 52 into more than two compartments.

The inlet 54 preferably comprises a chute portion 75 for directing particulate matter into the dispersing section 52 of the blending and dispersing device 50. The chute portion 75 typically comprises extensions of the front wall 58, the rear wall 64, and the side walls 60 and 62. It is preferable that the splitter element 74 extend into the chute portion 75 of the inlet 54. Alternatively, the splitter element 74 may not extend into the chute portion 75, or there may be more than one splitting element in the chute portion 75 that directs the particulate matter in some desired path from the inlet 54 to the dispersing section 52.

Although unnecessary for proper functioning of the blending and dispersing device 58, it is further contemplated that additional mixing devices (not shown) may be located directly above the inlet 54 to allow for additional particulate matter mixing. In a configuration of this type, when the particulate matter exits the additional mixing device, it will enter the inlet 54 of the blending and dispersing device 50 and be further blended as described below.

Figure 3:
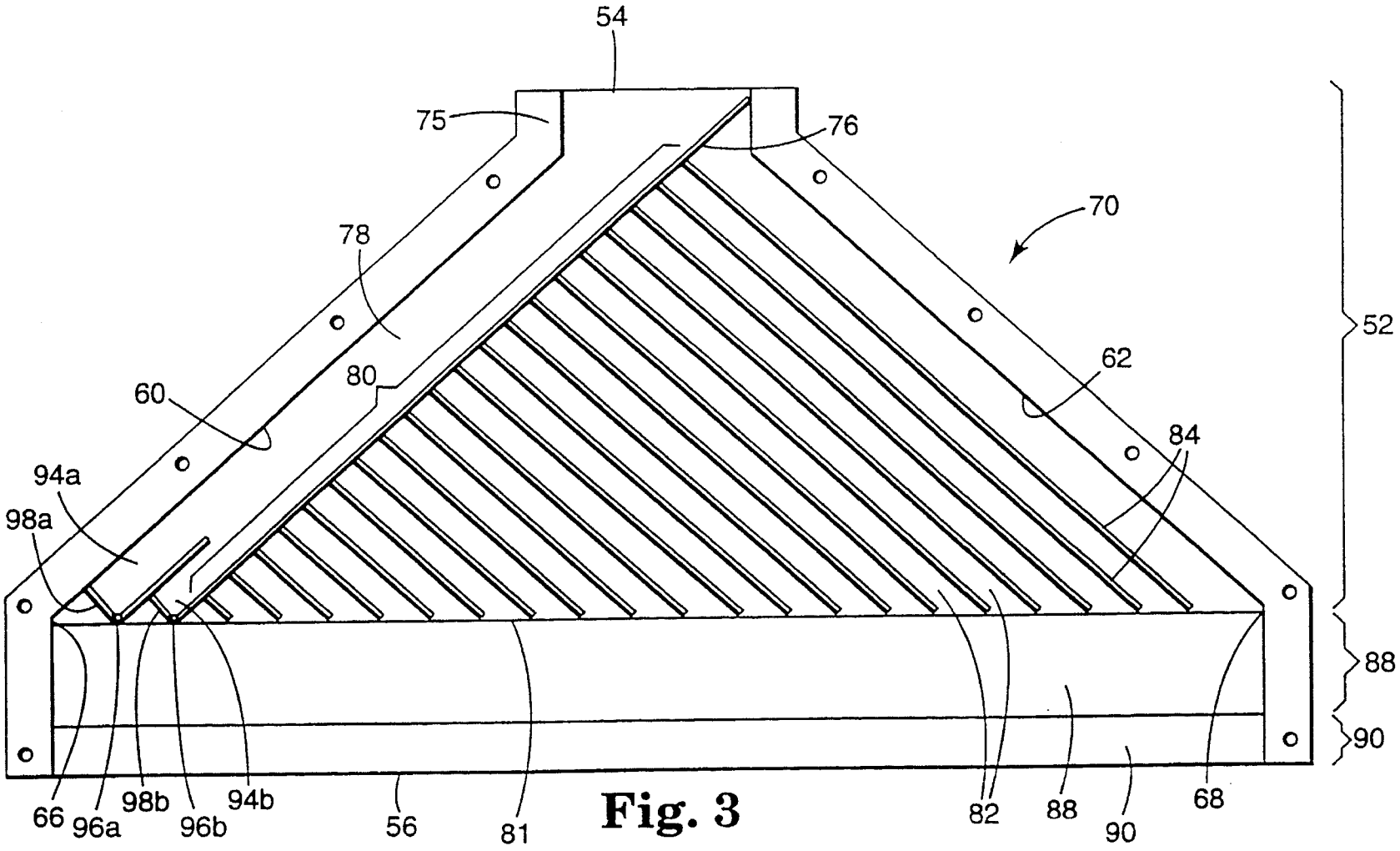
FIG. 3 is a view from the inside of a preferred embodiment of either the front or rear compartment disassembled from the other compartment of the blending and dispersing device.

FIG. 3 illustrates the front compartment as viewed from the inside of the blending and dispersing device 50. The description below is primarily directed to the front compartment 70, but it is to be understood that the description applies equally to the rear compartment 72. As shown, the front compartment 70 is further divided by a manifold plate 76 into a manifold cavity 78 and a transfer section 80, where the transfer section 80 is located substantially between the inlet 54 and an interface opening 81. More specifically, in the front compartment 70 the manifold plate 76 is spaced from the side wall 62 and slopes downwardly from one side of the inlet 54 toward the transverse end 68, thereby creating the manifold cavity 78 between the manifold plate 76 and the side wall 62. In the rear compartment 72 (see FIG. 5) a manifold plate 76 is similarly spaced from the side wall 60, but slopes from the opposite side of the inlet 54 toward the transverse end 66. In this configuration, the horizontal directional component of the slope of the manifold plate 76 in the rear compartment 72 is preferably in a opposite direction from the horizontal directional component of the slope of the manifold plate 76 in the front compartment 70, so that the manifold plate 76 in the rear compartment 72 is considered to have an "opposite" slope from the slope of the manifold plate 76 in the front compartment 70.

In the preferred embodiment, each manifold plate 76 is generally parallel to either side wall 60 or 62; however, other various configurations and locations of the manifold plates 76 relative to the side walls 60 and 62 are contemplated by the present invention, such as each manifold plate 76 converging or diverging with either side wall 60 or 62 when moving from the inlet 54 toward the outlet 56. It is further understood that the rate of particulate matter flow through the blending and dispersing device 50 may be varied by changing the angle of each of the manifold plates 76 relative to the outlet 56. Although the angle of the manifold plates may vary depending on the physical characteristics of the particulate matter to be dispersed, in the preferred embodiment, each of the manifold plates 76 is positioned at a 42 degree angle from the outlet 56. Moreover, the manifold cavity 78, specifically the length of the manifold plates 76, are preferably designed so that all of the particulate matter that falls into the front compartment 70 must travel into its manifold cavity 78 and all of the particulate matter that falls into the rear compartment 72 must travel into its manifold cavity 78 (see FIG. 5) of the rear compartment 72.

Figure 4:
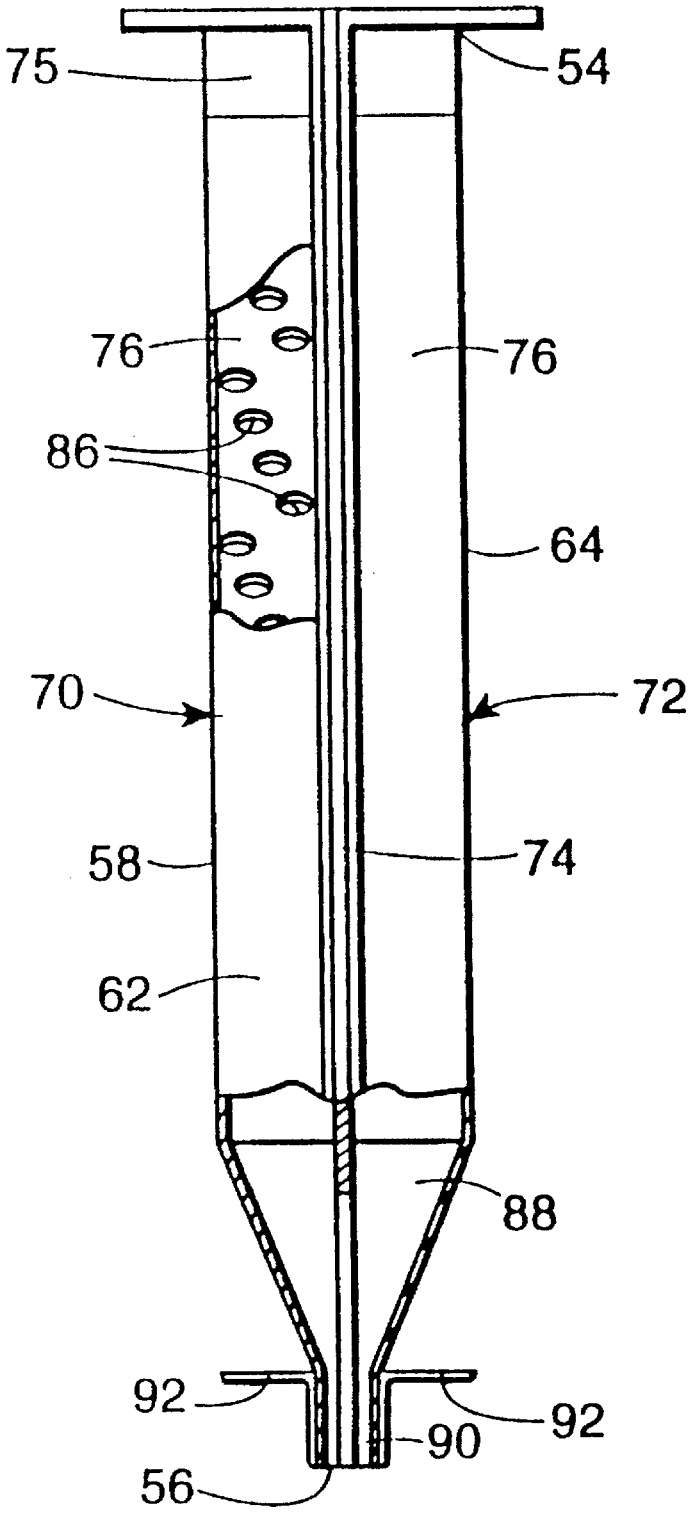
FIG. 4 is a side view of the blending and dispersing device partially in cross-section and partially broken away to show some of the interior details.

As best illustrated in FIG. 4, the manifold plate 76 preferably extends substantially the entire width of the front compartment 70 (i.e., the manifold plate 76 extends across substantially the entire space between the front wall 58 and the splitter element 74). Similarly, the other manifold plate 76 preferably extends across the entire space between the rear wall 64 and the splitter element 74. The manifold plate 76 is provided with a plurality of holes 86 which are preferably arranged in spaced relation over the entire length of the manifold plate 76. These holes 86 are preferably arranged along the length of the manifold plate 76 in a repeating pattern that maximizes the dispersion of particulate matter as it travels from the inlet 54 toward the outlet 56.

Figure 5:
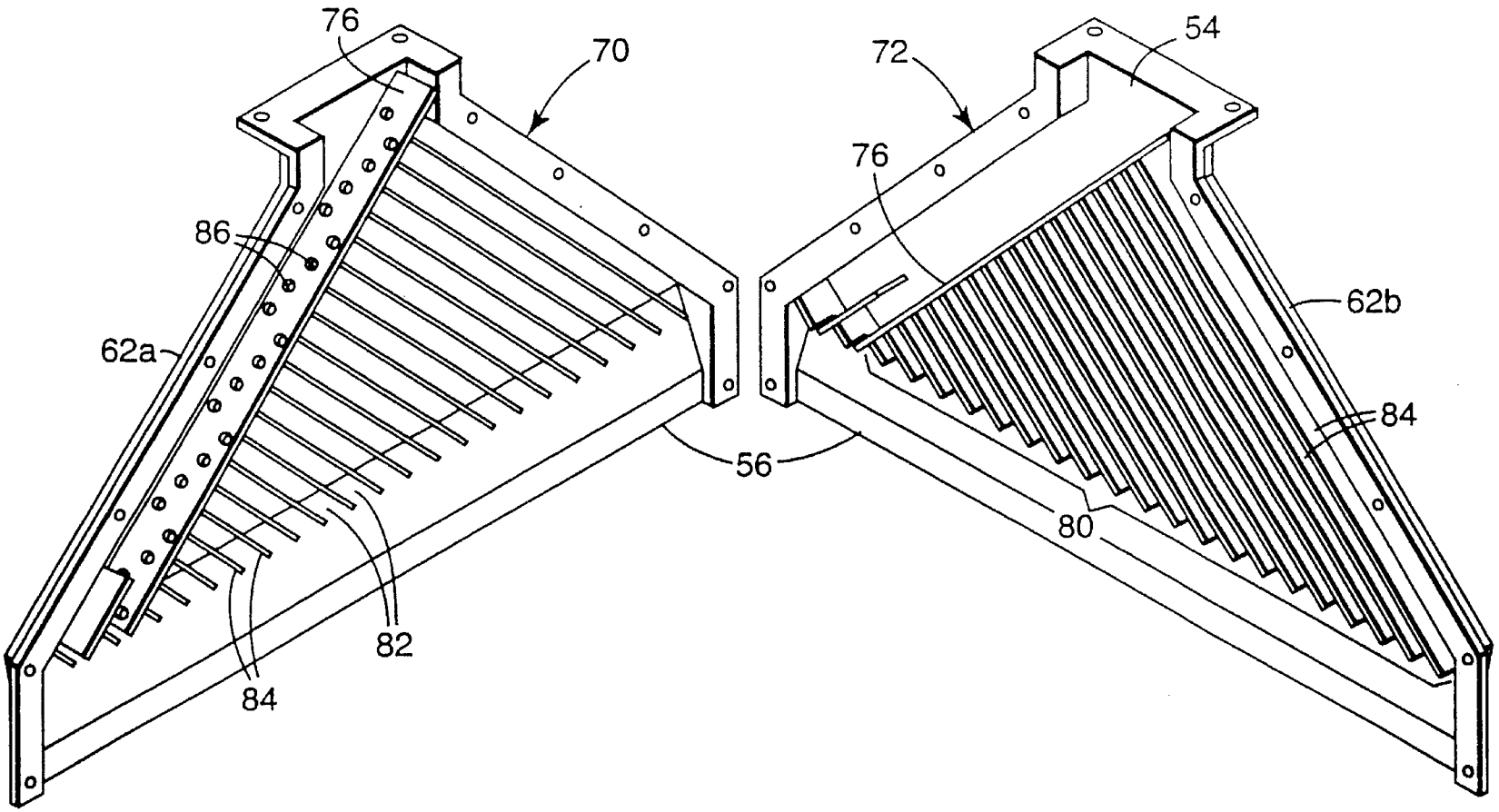
FIG. 5 is a isometric view of the front and rear compartments of the device of the present invention separated from each other and with the splitter element removed.
Figure 6:
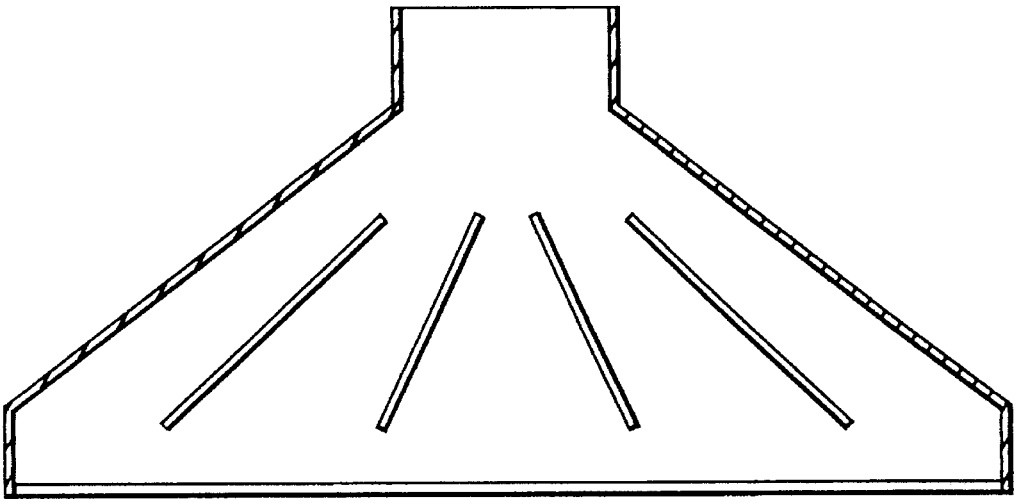
Fig. 6 PRIOR ART
FIG. 6 is a cross-sectional view of a prior art dispersing device with radially oriented baffle plates.
Figure 7:
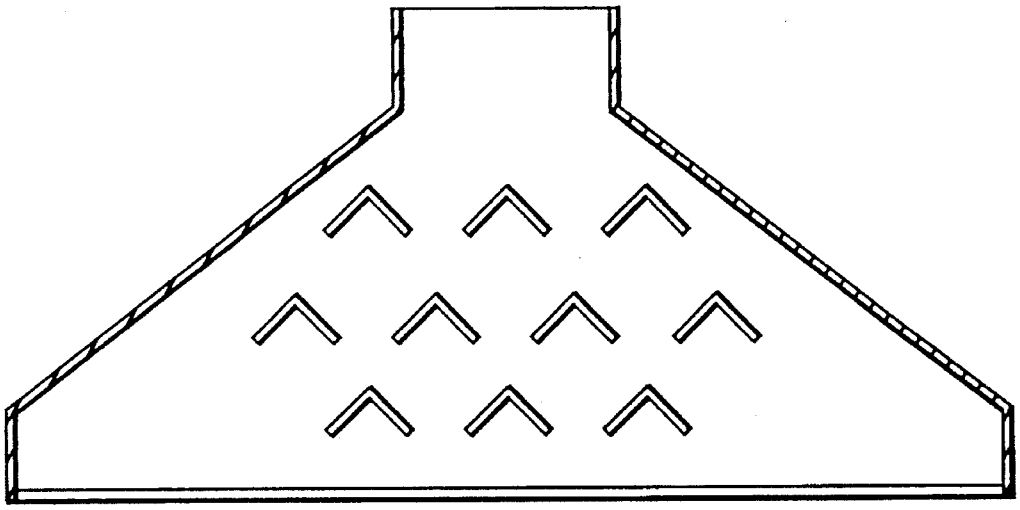
Fig. 7 PRIOR ART
FIG. 7 is a cross-sectional view of a prior art dispersing device with angled baffle plates.

FIGS. 4 and 5 illustrate a preferred hole arrangement, where, when moving down the manifold plate 76 from the inlet 54 toward the outlet 56, each hole 86 is placed at a progressively increasing distance from the front wall 58 (and a correspondingly decreasing distance from the splitter element 74) until one of the holes 86 is placed as near to the splitter element 74 as possible. The next hole 86 is then positioned nearest the front wall 58, and the pattern is repeated along the length of the manifold plate 76. In the illustrated embodiment, the repeating pattern of holes 86 comprises four holes 86.

Many alternative variations in the placement of the holes 86 along the length of the manifold plate 76 are contemplated by the present invention. For example, the pattern of holes 86 may comprise more or less than four holes 86, and/or may comprise any other repeating pattern of holes 86 along the length of the manifold plate 76. In the alternative, the holes 86 may be arranged randomly along the length of the manifold plate 76 so that no pattern of holes 86 is established.

Again referring to FIG. 3, in the preferred embodiment, the transfer section 80 is further subdivided into a plurality of lanes 82 by a plurality of spaced divider plates 84 that are generally parallel to each other and slope downwardly from the manifold plate 76 toward the interface opening 81. These divider plates 84 preferably subdivide the entire area of the transfer section 80 so that maximum dispersion of the particulate matter may be achieved at the interface opening 81. In the preferred configuration, the divider plates 84 are perpendicular to the manifold plate 76 so that the divider plates 84 actually slope in a generally opposite direction of the slope of the manifold plate 76. It is preferable that at least one hole 86 in the manifold plate 76 should open into each lane 82. Moreover, the divider plates 84 are preferably arranged so that each hole 86 in the manifold plate 76 is positioned between two of the divider plates 84 (see FIG. 5) and each hole 86 in the manifold plate 76 preferably corresponds with a single lane 82. More than one hole 86 may open into each lane 82, depending on the specific application.

The size of the holes 86 and the corresponding locations of the divider plates 84 defining the lanes 82 relative to the holes 86 may vary depending on the physical characteristics of the particulate matter to be dispersed, such as the size and type of the particulate matter, and the desired particulate matter output rate from the outlet 56. For example, it is typical in the roofing industry to blend roofing granules that range in size from 11 grade product to 35 grade product, with an 11 grade product being the preferred product grade. In the roofing industry, an 11 grade product means the highest percentage of granule grade will pass through a 10 mesh (Tyler, opening size 0.065 inch, 1.68 mm) screen but will be retained on a 14 mesh (Tyler, opening size 0.046 inch, 1.19 mm) screen. In the preferred embodiment, for example, when the desired output rate from the blending and dispersing device 50 is fourteen tons of 11 grade product per hour, each of the manifold plates 76 (which are at a 42 degree angle from the outlet 56, as discussed above) preferably have twenty holes 86 that are ⅝ inch (15.88 mm) in diameter. It is understood that variations in the relative angle of the manifold plates 76, the size of the holes 86, the number of holes 86, and the size and number of lanes 82 can be made depending on the size, flow rate, and parameters of the particular application of the particulate matter.

It is also noted that the interface opening 81 may function as the outlet for the particulate matter from the blending and dispersing device 50, so that as particulate matter falls from the lanes 82, it actually exits the blending and dispersing device 50. However, in the preferred embodiment, supported between the interface opening 81 and the outlet 56 is a blending area 88 and a elongated outlet opening 90, as illustrated in FIGS. 3 and 4. The blending area 88 and elongated outlet opening 90 preferably have the same transverse width as the interface opening 81. In the preferred embodiment, the splitter element 74 extends from the inlet 54 to the interface opening 81, but extends only slightly into the blending area 88; however, the splitter element 74 may alternatively extend the entire distance between the interface opening 81 and the elongated outlet opening 90, or may not extend at all into the blending area 88. When the splitter element 74 doesn't extend at all into the blending area 88 or only partially extends into the blending area 88, the particulate matter from the front compartment 70 and the rear compartment 72 are allowed to combine with each other as they pass through the blending area 88 and travel toward the elongated outlet opening 90. The blending area 88 preferably tapers down toward the elongated outlet opening 90 so that the particulate matter may be dispensed in a more concentrated stream from outlet 56, where the particulate matter may then be discharged from the outlet 56 of the blending and dispersing device 50 either onto a sheeting, into a storage bin, or to some other device for discharging particulate matter.

FIG. 4 also illustrates two support flanges 92, one mounted on each side of the elongated outlet opening 90 (i.e., one on the side of the front wall 58 and one on the side of the rear wall 64). These support flanges 92 may be used for mounting the blending and dispersing device 50 in a desired position for dispensing particulate matter.

Referring again to FIG. 3, the lower end of the manifold cavity 78 is preferably divided into two manifold cavity lanes 94*a* and 94*b*, with manifold openings 96*a* and 96*b* located at the bottom of each of the manifold cavity lanes 94*a* and 94*b*, respectively. The particulate matter that passes to the bottom of the manifold cavity 78 without falling into one of the lanes 82 will fall into one of the manifold cavity lanes 94*a* or 94*b* and to the manifold bottom walls 98*a* and 98*b*. These manifold bottom walls 98*a* and 98*b* are angled to direct the particulate matter to the manifold openings 96*a* and 96*b*. Like the lanes 82, these manifold openings 96*a* and 96*b* dispense particulate matter into the blending area 88 before dispensing the particulate matter from the outlet 56. One feature of the manifold openings 96*a* and 96*b* is that they allow for self-purging or self-cleaning of the manifold cavity 78; to purge existing particulate matter from of the manifold cavity 78, new particulate matter may be added at the inlet 54, which will force the existing particulate matter from the manifold cavity 78° Alternatively, the blending and dispersing device 50 may be vibrated or agitated in some way to encourage any particulate matter remaining in the manifold cavity 78 to fall through the manifold openings 96*a* and 96*b*.

FIG. 5 illustrates the blending and dispersing device 50 separated along the splitter element 74 (not shown in this Figure) into the front compartment 70 and the rear compartment 72. As illustrated, when the two compartments 70 and 72 are viewed side-by-side from the inside of the blending and dispersing device 50, the front compartment 70 is virtually identical to the rear compartment 72. However, it is contemplated that front and rear compartments 70 and 72 may be different from each other when viewed side-by-side from the inside. In the preferred embodiment, when the compartments 70 and 72 have the same construction and are assembled so that the dispersing sections 52 are facing each other, the manifold plate 76 and divider plates 84 of the front compartment 70 slope in the opposite direction of the manifold plate 76 and divider plates 84 of the rear compartment 72, respectively.

The typical operation of the blending and dispersing device 50 is as follows; one or more supply sources, which may include hoses, pipes, nozzles, or other suitable devices for feeding a metered flow of particulate matter to the mixer, may be provided to feed the proper proportions of particulate matter to the blending and dispersing device 50. Although the particulate matter may be fed directly into the inlet 54, a hopper (not shown) may be provided above the inlet 54 so that the particulate matter may instead be fed into the hopper and subsequently fall into the inlet 54. The particulate matter entering the inlet 54 of the dispersing section 52 may either fall directly into the front compartment 70 or the rear compartment 72 or may instead strike the top of the splitter element 74 so that some of that particulate matter will fall into the front compartment 70 and the remaining particulate matter will fall into the rear compartment 72. After entering either the front compartment 70 or the rear compartment 72, the particulate matter is directed into the manifold cavity 78 of the respective compartment.

The particulate matter is further diffused as it continues to fall through the holes 86 in the manifold plate 76 into the lanes 82, for an even distribution thereof across the entire cross-sectional area of the interface opening 81 from that compartment. The particulate matter passing through the front compartment 70 will move toward the transverse end 66 as it moves through the dispersing section 52 and the particulate matter in the rear compartment 70 will move toward the transverse end 68 as it also moves through the dispersing section 52. This action provides for dispersion of the particulate matter through the dispersing section 52 in opposite directions to the interface opening 81. The different streams of particulate matter fall through and leave the lanes 82 of the front compartment 70 and the rear compartment 72 at the interface opening 81 and come together in the blending area 88. The tapering funnel-like shape of the blending area 88 brings the different streams of particulate matter back together into a single stream and insures that the particulate matter leaving the blending and dispersing device 50 is a combination of the many fractional streams produced during the fall. The particulate matter then moves from the blending area 88 into the elongated outlet opening 90 and exits the outlet 56 for application onto a web product, such as described in regard to FIG. 1, or may be directed for use in some other manner. In the result, an effective blending of particulate matter is achieved by the mere gravity flow of the material.

Free movement of particulate matter within the blending and dispersing device 50 of the present invention is not necessary. Rather, blending can be achieved automatically through gravity flow of the particulate matter using a choke-fed system, where blending takes place while the entire device 50 is filled with granules. In addition, since particulate matter blending may be achieved when the device 50 is filled with granules, if the device 50 is situated in the same or in a different orientation than that illustrated, blending may also be achieved by applying external pressure to move the particulate matter through the device 50.

The control of the discharge of the particulate matter at the outlet 56 can be variously organized and provided for. For example, a rotating roll (not shown) may be situated under the outlet 56 with a specific gap set between the roll and the outlet 56. The gravity flow of the particulate matter will tend to fill the gap and the particulate matter will be carried away from the gap as the roll rotates. The rate of output of particulate matter from the blending and dispersing device 50 may be controlled by setting size of the gap and the speed of the roll that carries the particulate matter away from the blending and dispersing device 50. Alternatively, the blending and dispersing device 50 may be mounted so that the particulate matter is dispersed in a different manner into some other manufacturing process.

What is claimed is:

1. A static blending device for receiving and dispersing particulate matter comprising:

an inlet having transverse inlet ends for receiving particulate matter, wherein a transverse width of said inlet is defined between said transverse inlet ends;

an outlet having transverse outlet ends for dispensing particulate matter, wherein a transverse width of said outlet is defined between said transverse outlet ends and said transverse width of said outlet is larger than said transverse width of said inlet, and;

a dispersing section provided intermediate of said inlet and said outlet, said dispersing section being divided into a first compartment and a second compartment by a splitter element that extends in the direction of said transverse width of said outlet and said transverse width of said inlet, wherein said first compartment is defined between a side wall and said splitter element and said second compartment is defined between another side wall and said splitter element, and wherein means are provided within said first compartment for moving particulate matter that falls within said first compartment toward one of said transverse outlet ends as it travels from said inlet to said outlet and means are provided within said second compartment for moving particulate matter that falls within said second compartment toward the other of said transverse outlet ends as it travels from said inlet to said outlet.

2. The static blending device of claim 1, wherein at least one inlet splitter element extends from said splitter element of said dispersing section and is operatively supported within said inlet.

3. The static blending device of claim 2, wherein said inlet splitter element is coplanar with said splitter element of said dispersing section.

4. The static blending device of claim 3, wherein said inlet splitter element and said splitter element of said dispersing section are a unitary splitter element.

5. The static blending device of claim 1, wherein a blending area is provided between said dispersing section and said outlet for collecting and blending the particulate matter from said first compartment and said second compartment.

6. The static blending device of claim 1, wherein said means for moving particulate matter within said first compartment comprises a first manifold plate that is operatively supported between said side wall and said splitter element and slopes in one direction, and wherein said means for moving particulate matter within said second compartment comprises a second manifold plate that is operatively supported between said another side wall and said splitter element and slopes in another direction, wherein at least one directional component of the slope of said first manifold plate is in an opposite direction from at least one directional component of the slope of said second manifold plate.

7. The static blending device of claim 6, wherein said first manifold plate has a length and generally divides said first compartment of said dispersing section into a first manifold cavity and a first transfer section, and said second manifold plate has a length and generally divides said second compartment of said dispersing section into a second manifold cavity and a second transfer section, wherein the movement of particulate matter toward one of said transverse outlet ends takes place within said first transfer section and the movement of particulate matter toward the other of said transverse outlet ends takes place within said second transfer section.

8. The static blending device of claim 7, wherein said first manifold plate comprises multiple manifold openings provided along said length of said first manifold plate and said second manifold plate comprises multiple manifold openings provided along said length of said second manifold plate.

9. The static blending device of claim 8, wherein said means for moving particulate matter within said first compartment further comprises multiple divider plates within said first transfer section for defining lanes, wherein each of said lanes is associated with at least one of said manifold openings in said first manifold plate so that particulate matter entering said first manifold cavity falls through said manifold openings in said first manifold plate into said lanes and is shifted toward one of said transverse outlet ends and wherein said means for moving particulate matter within said second compartment further comprises multiple divider plates within said second transfer section for defining lanes, wherein each of said lanes is associated with at least one of said manifold openings in said second manifold plate so that particulate matter entering said second manifold cavity falls through said manifold openings in said second manifold plate into said lanes and is shifted toward the other of said transverse outlet ends.

10. The static blending device of claim 8, wherein said manifold openings in said first manifold plate and said manifold openings in said second manifold plate are located at varying distances from said splitter element.

11. The static blending device of claim 10, wherein groups of said manifold openings are spaced from said splitter element in a repeating pattern along said length of said first manifold plate and along said length of said second manifold plate.

12. The static blending device of claim 10, wherein said manifold openings are randomly spaced from said splitter element along said first length of said first manifold plate and along said second length of said second manifold plate.

13. A static blending device for receiving and dispersing roofing granules for application to a roofing material comprising:

an inlet having transverse inlet ends for receiving roofing granules, wherein a transverse width of said inlet is defined between said transverse inlet ends;

an outlet having transverse outlet ends for dispensing roofing granules, wherein a transverse width of said outlet is defined between said transverse outlet ends and said transverse width of said outlet is larger than said transverse width of said inlet, and;

a dispersing section provided intermediate of said inlet and said outlet, said dispersing section being divided into a first compartment and a second compartment by a splitter element that extends in the direction of said transverse width of said outlet and said transverse width of said inlet, wherein said first compartment is defined between a side wall and said splitter element and said second compartment is defined between another side wall and said splitter element, and wherein means are provided within said first compartment for moving roofing granules that fall within said first compartment toward one of said transverse outlet ends as it travels from said inlet to said outlet and means are provided within said second compartment for moving roofing granules that fall within said second compartment toward the other of said transverse outlet ends as it travels from said inlet to said outlet.

14. The static blending device of claim 13, wherein said means for moving roofing granules within said first compartment comprises a first manifold plate that is operatively supported between said side wall and said splitter element and slopes in one direction, and wherein said means for moving roofing granules within said second compartment comprises a second manifold plate that is operatively supported between said another side wall and said splitter element and slopes in another direction, wherein at least one directional component of the slope of said first manifold plate is in an opposite direction from at least one directional component of the slope of said second manifold plate.

15. The static blending device of claim 14, wherein said first manifold plate has a length and generally divides said first compartment of said dispersing section into a first manifold cavity and a first transfer section, and said second manifold plate has a length and generally divides said second compartment of said dispersing section into a second manifold cavity and a second transfer section, wherein the movement of roofing granules toward one of said transverse outlet ends takes place within said first transfer section and the movement of roofing granules toward the other of said transverse outlet ends takes place within said second transfer section.

16. The static blending device of claim 15, wherein said first manifold plate comprises multiple manifold openings provided along said length of said first manifold plate and said second manifold plate comprises multiple manifold openings provided along said length of said second manifold plate.

17. The static blending device of claim 16, wherein said means for moving roofing granules within said first compartment further comprises multiple divider plates within said first transfer section for defining lanes, wherein each of said lanes is associated with at least one of said manifold openings in said first manifold plate so that roofing granules entering said first manifold cavity fall through said manifold openings in said first manifold plate into said lanes and are shifted toward one of said transverse outlet ends and wherein said means for moving roofing granules within said second compartment further comprises multiple divider plates within said second transfer section for defining lanes, wherein each of said lanes is associated with at least one of said manifold openings in said second manifold plate so that roofing granules entering said second manifold cavity fall through said manifold openings in said second manifold plate into said lanes and is shifted toward the other of said transverse outlet ends.

18. The static blending device of claim 16, wherein said manifold openings in said first manifold plate and said manifold openings in said second manifold plate are located at varying distances from said splitter element.

* * * * *

UNITED STATES PATENT AND TRADEMARK OFFICE

CERTIFICATE OF CORRECTION

PATENT NO.: 5,531,831

DATED: July 2, 1996

INVENTOR(S): Sweeney et al.

It is certified that error appears in the above-identified patent and that said Letters Patent is hereby corrected as shown below:

Col. 9, line 63, "78° Alternatively," should be
--78. Alternatively,--.

Signed and Sealed this

Fourth Day of March, 1997

*Attest:*

Bruce Lehman

BRUCE LEHMAN

*Attesting Officer*

*Commissioner of Patents and Trademarks*